US011988084B2

(12) United States Patent
Pihl

(10) Patent No.: US 11,988,084 B2
(45) Date of Patent: May 21, 2024

(54) ELECTRONICS ENCLOSURE WITH GLASS PORTION FOR USE IN A WELLBORE

(71) Applicant: Halliburton Energy Services, Inc., Houston, TX (US)

(72) Inventor: Joachim Pihl, Sandefjord (NO)

(73) Assignee: Halliburton Energy Services, Inc., Houston, TX (US)

( * ) Notice: Subject to any disclaimer, the term of this patent is extended or adjusted under 35 U.S.C. 154(b) by 25 days.

(21) Appl. No.: 17/819,869

(22) Filed: Aug. 15, 2022

(65) Prior Publication Data

US 2024/0052739 A1 Feb. 15, 2024

(51) Int. Cl.
*E21B 47/017* (2012.01)

(52) U.S. Cl.
CPC ..... *E21B 47/017* (2020.05)

(58) Field of Classification Search
CPC ... E21B 47/017; E21B 47/013; E21B 17/0283
See application file for complete search history.

(56) References Cited

U.S. PATENT DOCUMENTS 6,768,700 B2 * 7/2004 Veneruso ..... E21B 17/028 340/853.2
9,000,873 B2 4/2015 Deville et al.
2003/0159823 A1 * 8/2003 Pichery ..... E21B 23/03 166/250.01
2007/0216415 A1 9/2007 Clark et al.
2008/0238427 A1 10/2008 Clark et al.
2013/0057387 A1 * 3/2013 Binmore ..... E21B 17/006 408/1 R
2013/0181799 A1 7/2013 Deville et al.
2016/0237803 A1 * 8/2016 Patel ..... E21B 33/0407
2018/0292563 A1 * 10/2018 Zhong ..... G01V 3/30
2019/0309617 A1 10/2019 Godager et al.

OTHER PUBLICATIONS

International Patent Application No. PCT/US2022/075042, International Search Report and Written Opinion dated May 9, 2023, 13 pages.
Emerson, "Roxar Downhole Wireless PT Sensor System—Annulus B", Offshore News, Jul. 2011, 1 page.
Halliburton Energy Services, Inc., "DataSphere LinX Monitoring System", Product Sheet, 2021, 2 pages.
Schlumberger, "Manara production and reservoir management system", Product Sheet, 2020, 2 pages.

* cited by examiner

*Primary Examiner* — Giovanna Wright
(74) *Attorney, Agent, or Firm* — Kilpatrick Townsend & Stockton LLP

(57) ABSTRACT

A sealed enclosure can include a glass portion that can be positioned with respect to an electromagnetic component that is in an area defined by the sealed enclosure. The enclosure can prevent fluid from a wellbore environment from contacting the electromagnetic component and to allow the electromagnetic component to wirelessly communicate with a component external to the sealed enclosure. A second portion interfaces with the glass portion for preventing the fluid from the wellbore environment from contacting the electromagnetic component.

17 Claims, 6 Drawing Sheets

ELECTRONICS ENCLOSURE WITH GLASS PORTION FOR USE IN A WELLBORE

TECHNICAL FIELD

The present disclosure relates generally to wellbore drilling operations and, more particularly (although not necessarily exclusively), to a glass enclosure for use in wellbore operations.

BACKGROUND

Hydrocarbons, such as oil and gas, can be extracted from subterranean formations that may be located onshore or offshore. Hydrocarbons can be extracted through a wellbore formed in a subterranean formation. Wellbore operations for extracting hydrocarbons can include drilling operations, completion operations, production operations, and the like.

A wide array of electrical devices, such as sensors, controlling devices, and power management devices may be deployed during wellbore operations. Such electronic devices may be sensitive and have protective enclosures from a hazardous wellbore environment. Various enclosures may be used in wellbore operations to shield electronic devices from the chemicals, temperatures, pressures, and other hazards that may be present in a wellbore environment. Such enclosures may inhibit communication with the electronics from devices external to the enclosures.

DETAILED DESCRIPTION

Figure 1:
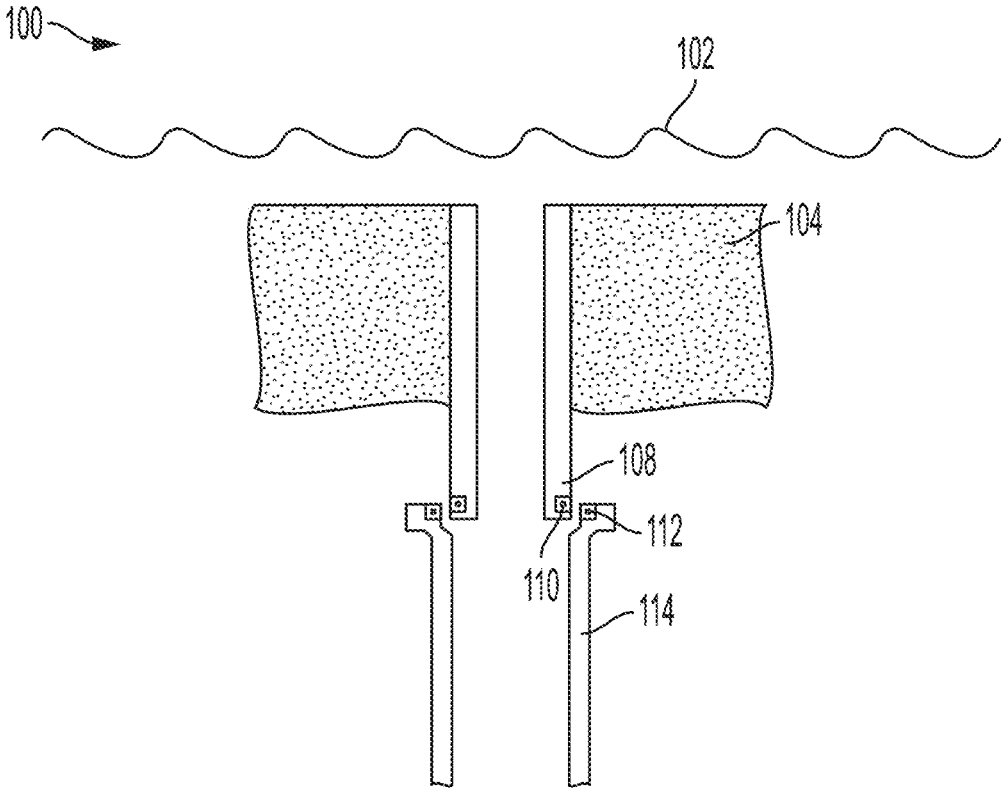
FIG. 1 is a cross-sectional view of a wellbore in a completion stage according to one example of the present disclosure.

Certain aspects and examples of the present disclosure relate to an electronics enclosure that is at least partially constructed with glass and that can be used in wellbore operations. The enclosure may be constructed to house electronics used in wellbore operations. Electronics may include sensors, antennas, transmitters, solenoids, transformers, inductive couplers, circuitry, processing devices, amplifiers, inverters, rectifiers, motors, batteries, electromagnets, or capacitors. The enclosure may provide protection from corrosive chemicals, moisture, oxidization, high absolute pressure, large changes in pressure, high temperatures, large changes in temperature, vibrations, and abrasion. The protection afforded by the enclosure may allow for longer installations or permanent installations of certain wellbore tools. Wellbore operations may include drilling operations, completion operations, or production operations.

Electronics enclosures partially or fully constructed with glass may allow for increased bandwidth and efficiency between the electronics housed within such enclosures when compared to fully metallic electronics enclosures. For example, a first inductive coupler housed in a first enclosure with a glass portion may achieve higher bandwidth or higher power transfer efficiency with a second inductive coupler housed in a second enclosure with a glass portion when the glass portions of each enclosure are oriented to allow electromagnetic waves to propagate through the glass portions as opposed to propagating through metal enclosures.

The higher bandwidth or higher power transfer efficiency may be attributable to the glass portions having lower magnetic or lower conductive qualities than a metallic housing. The lower magnetic and lower conductive qualities of the glass portions may contribute to a lower base load than a fully metallic enclosure. Replacing a portion of a fully metallic enclosure with a glass portion or replacing the fully metallic enclosure with a fully glass enclosure may also improve inverter, rectifier, and transmission losses as well as allow electronics within the enclosure to operate at a lower idle current.

In one example, a thin-walled glass tube may be used instead of a metallic shield tube to protect a coil element from the downhole environment. Glass and steel may overlap for creating a sealed cavity for coils or any electronics. The seal, although also most likely a polymer, may have a small cross section exposed to a wellbore environment as compared to a cast polymer enclosure. The seal may also have a long path length from the wellbore environment to the housed electronics, so any diffusion of contaminants into the main chamber may be slowed enough to meaningfully extend the lifespan of the electronics within the enclosure. Vacuum casting or some other technique may be used to fill the sealed chamber with heat resistant polymer to prevent the glass from acting as a structural member and breaking due to environmental pressure.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a cross-sectional view of a wellbore 100 in a completion stage according to one example of the present disclosure. A second assembly 114 of completion equipment accepts a first assembly 108 of completion equipment beneath a surface 102, within a geological formation 104. The first assembly 108 includes a first inductive coupler 110. The second assembly 114 includes a second inductive coupler 112.

In some examples, the first inductive coupler 110 may be housed in an electronics enclosure with a glass portion and the second inductive coupler 112 may also be housed in an electronics enclosure with a glass portion. In some such examples, the glass portion of the enclosure housing the first inductive coupler 110 may face the glass portion of the enclosure housing the second inductive coupler 112. In an alternative example, the first inductive coupler 110 may be housed in an electronics enclosure with multiple glass portions or the second inductive coupler 112 may be housed in an electronics enclosure with multiple glass portions.

The first inductive coupler 110 and the second inductive coupler 112 may create an electromagnetic connection between the first assembly 108 and the second assembly 114. The electromagnetic connection between the first assembly 108 and the second assembly 114 may allow for transmission and reception of electrical power and data signals between the first assembly 108 and the second assembly 114. For example, the exchange of power and data signals that may be afforded by the bandwidth and power transfer efficiency of inductive couplers housed in electronics enclosures with glass portions could power and actuate electronic inflow control valves.

Figure 2:
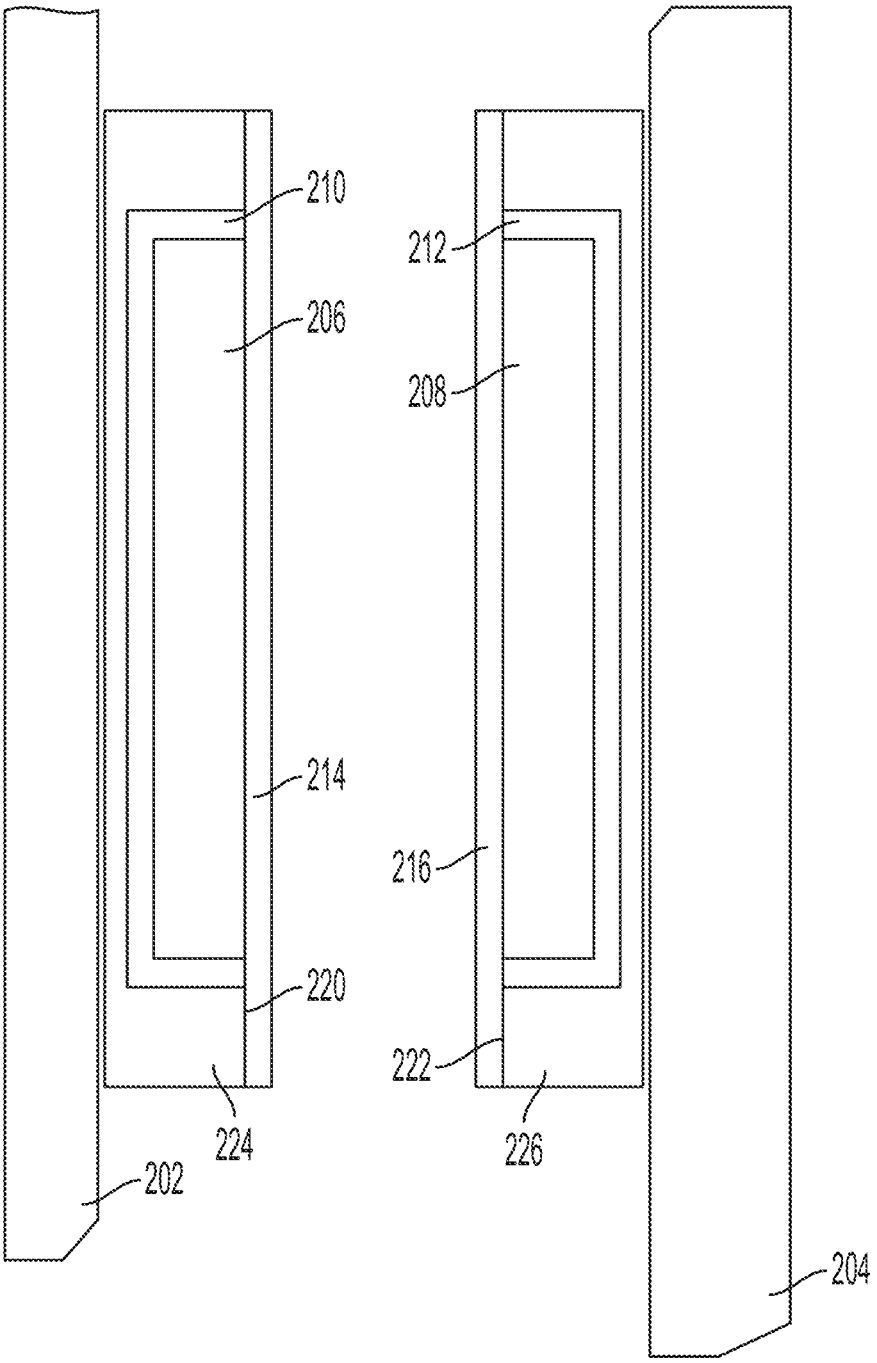
FIG. 2 is a cross-sectional view of a first assembly electronics enclosure facing a second assembly electronics enclosure according to one example of the present disclosure.

FIG. 2 is a cross-sectional view of a first assembly electronics enclosure 202 facing a second assembly electronics enclosure 204 according to one example of the present disclosure. The first assembly electronics enclosure 202 includes a first core 210, a first coil 206, a first glass tube 214, and a first shield 224. The first glass tube 214 and the first shield 224 meet at a first contact area 220. The second assembly electronics enclosure 204 includes a second core 212, a second coil 208, a second glass tube 216, and a second shield 226. The second glass tube 216 and the second shield 226 meet at a second contact area 222. While the first assembly electronics enclosure 202 is illustrated facing the second assembly electronics enclosure 204 in a vertical orientation, other orientations are also possible.

A varying electric current from the first coil 206 may produce a magnetic flux within the first core 210. The magnetic flux from the first core 210 may transfer, through the first glass tube 214 and the second glass tube 216, into the second core 212. The magnetic flux within the second core 212 may produce another varying electric current within the within the second coil 208. The current produced in the second coil 208, originating from the current of the first coil 206, may allow for a transfer of electrical power between a first assembly and a second assembly of completion equipment, production equipment, or a drilling assembly. In some examples, the first coil 206, first core 210, second coil 208, and second core 212 may behave as a transformer, wherein the first coil 206 operates at a voltage different from the voltage of the second coil 208. In some examples, the current produced in the second coil 208 from the first coil 206 may allow for a transfer of data.

The glass tubes 214, 216 and the shields 224, 226 may protect the coils 206, 208 from a wellbore environment and act as a chemical shield. This may include protection from corrosive chemicals, moisture, oxidization, high absolute pressure, large changes in pressure, high temperatures, large changes in temperature, vibrations, and abrasion.

The glass tubes 214, 216 may be constructed from chemically strengthened glass. A chemical strengthening process may involve immersing glass in a high temperature, potassium-salt, ion-exchange bath. The glass may be an alkali-aluminosilicate glass. The shields 224, 226 may be constructed from any suitable metal or metallic alloy.

In some examples, the shields 224, 226 may be constructed from glass. The glass tubes 214, 216 or the shields 224, 226 may be constructed with laminated glass or layered panes of glass. In some examples, the glass tubes 214, 216 and the shield 224, 226 may be, respectively, integrally formed together or may be separate but coupled components that are not integrally formed together. For example, glass tube 214 may be integrally formed with shield 224 that is also glass such that the shield 224 is a portion of the overall glass structure that can prevent fluid from a wellbore environment from contacting the first coil 206. And, the second glass tube 216 and the second shield 226 may be integrally formed together and the second shield 226 is a portion of the glass in the overall class structure that can prevent fluid from a wellbore environment from contacting the second coil 208.

In examples where the glass tubes 214, 216 and the shields 224, 226 are not integrally formed together, such as the example depicted in FIG. 2, the first contact area 220 and second contact area 222 may contain a resin based epoxy for bonding the glass tubes 214, 216 to a metal, metallic, or glass surface of the shields 224, 226. In examples where the glass tubes 214, 216 and the shields 224, 226 may be either integrally formed together or subsets of overall glass structures, the first contact area 220 and second contact area 222 may contain a resin-based epoxy for bonding the glass tubes 214, 216 to a metal or metallic surface of the assembly electronics enclosures 202, 204. In some such examples, the contact areas may be located differently than the contact areas 220, 222.

The length of the first contact area 220 and the length of the second contact area 222 may be constructed to slow the diffusion of air, water, caustic chemicals, or other contaminants from the wellbore environment to either coil 206, 208 or either core 210, 212. The cross section of a portion of the first contact area 220 or second contact area 222 exposed to the wellbore environment may be minimized to slow the diffusion of air, water, caustic chemicals, or other contaminants as well.

Vacuum casting, or similar techniques, may be used to fill the first assembly electronics enclosure 202 or the second assembly electronics enclosure 204 with a heat resistant polymer. The heat resistant polymer may reinforce the glass tubes 214, 216. In some examples, the first assembly electronics enclosure 202 or the second assembly electronics enclosure 204 may be filled with a pressure compensated fluid. In some such examples, a specific pressure compensation system may manage the fluid contents of the first assembly electronics enclosure 202 or the second assembly electronics enclosure 204.

Figure 3:
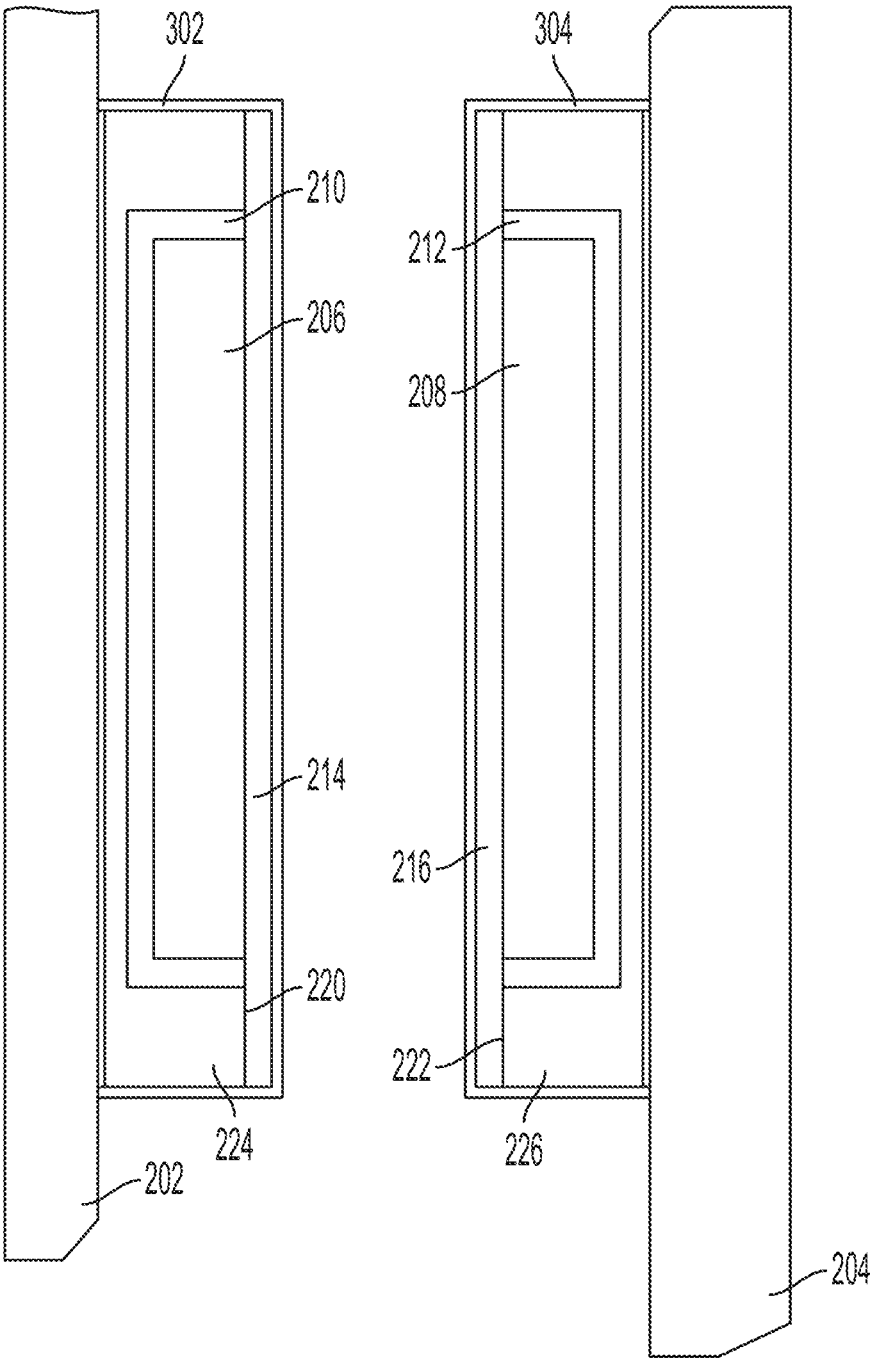
FIG. 3 is a cross-sectional view of a first assembly electronics enclosure facing a second assembly electronics enclosure according to one example of the present disclosure.

FIG. 3 is a cross-sectional view of a first assembly electronics enclosure 202 facing a second assembly electronics enclosure 204 according to one example of the present disclosure. The elements of FIG. 3 are the same as the elements of FIG. 2 except for a first rubber lining 302 covering the first glass tube 214 and first shield 224 of the first assembly electronics enclosure 202 and a second rubber lining 304 covering the second glass tube 216 and second shield 226 of the second assembly electronics enclosure 204.

The rubber linings 302, 304 may protect the glass tubes 214, 216, the shields 224, 226, and the contact areas 220, 222 from corrosive chemicals, moisture, oxidization, high absolute pressure, large changes in pressure, high temperatures, large changes in temperature, vibrations, and abrasion. In some examples, the rubber linings 302, 304 may partially cover some combination of the glass tubes 214, 216, the shields 224, 226, and the contact areas 220, 222. The rubber lining may allow for a similar exchange of magnetic flux between the first core 210 and the second core 212 as described with respect to FIG. 2, thus allowing the same exchange of electrical current between the first coil 206 and the second coil 208. In some examples, the rubber linings 302, 304 may be replaced with plastic linings. The rubber linings 302, 304, or plastic linings may be applied as coatings, sleeves, sheets, or any other suitable means of application.

Figure 4:
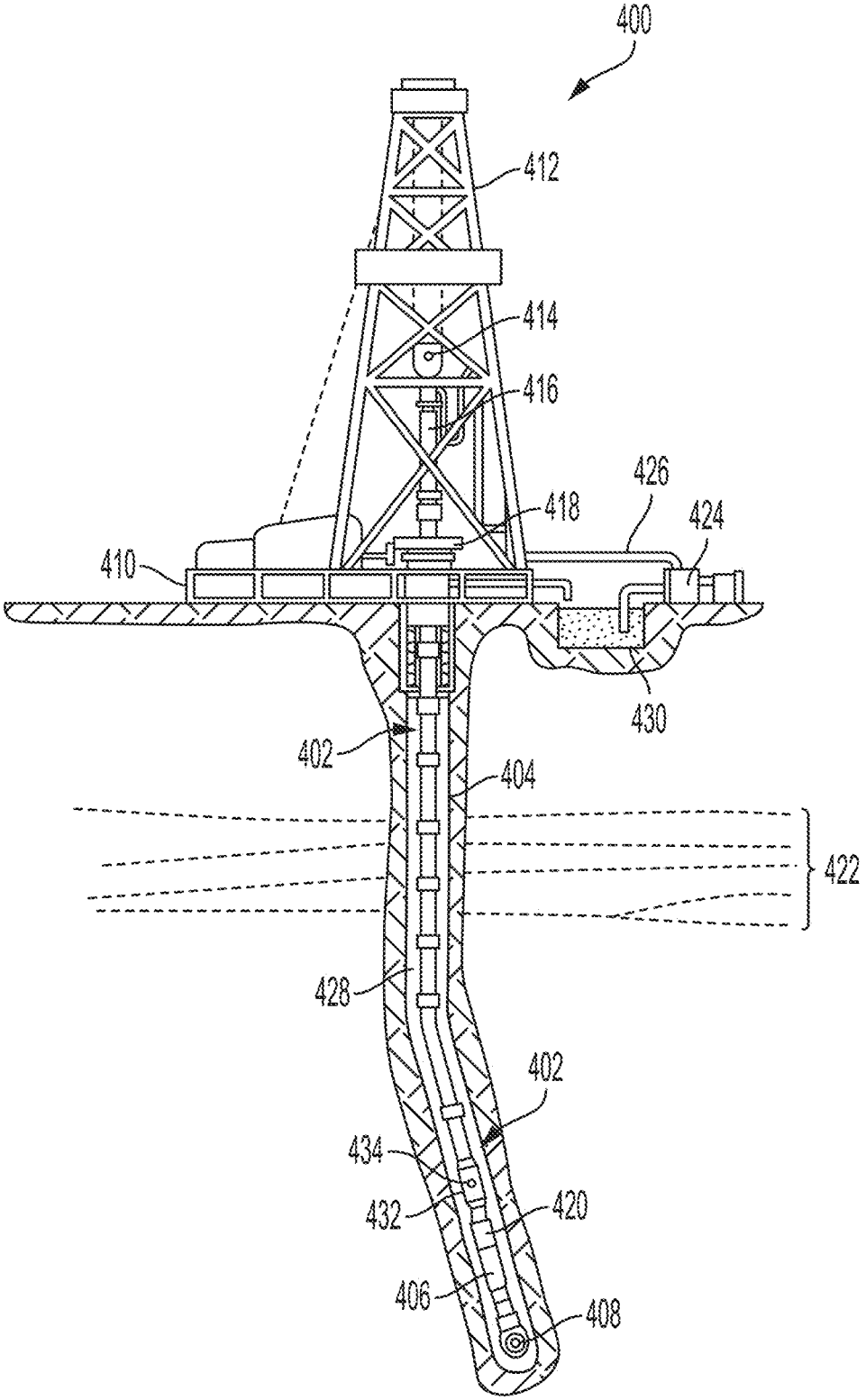
FIG. 4 is a schematic view of a drilling system with an electronics enclosure with a glass portion according to one example of the present disclosure.

FIG. 4 is a schematic view of a drilling system 400 with an electronics enclosure with a glass portion 432 according to one example of the present disclosure. The drilling system 400 can direct a drill bit 408 in drilling a directional borehole 404, such as a subsea well or a land well. Although the drilling system 400 is described with reference to drilling a directional borehole 404 for extracting oil, drilling systems according to various examples of the disclosure can be used for drilling other times of wellbores, such as natural gas wellbores, other hydrocarbon wellbores, or wellbores in general. Further, various examples can be used for exploring and forming geothermal wellbores intended to provide a source of heat energy instead of hydrocarbons.

FIG. 4 shows a drill string 402 disposed in the directional borehole 404. The drill string 402 includes a push-the-bit rotary steerable system (RSS) 406 that can provide full directional control of the drill bit 408. A drilling platform 410 supports a derrick 412 having a travelling block 414 that may raise and lower the drill string 402. A kelly bushing 416 supports the drill string 402 as the drill string 402 may be lowered through a rotary table 418. Alternatively, a top drive can be used to rotate the drill string 402 in place of the kelly bushing 416 and the rotary table 418. A drill bit 408 is positioned at the downhole end of the drill string 402 and can be driven by rotation of the entire drill string 402 from the surface or by a downhole motor 420 positioned on the drill string 402. As the drill bit 408 rotates, the drill bit 408 may form the borehole 404 that passes through various formations 422. A pump 424 may circulate drilling fluid through a feed pipe 426 and downhole through the interior of the drill string 402, through orifices in the drill bit 408, back to the surface via the annulus 428 around the drill string 402, and into a retention pit 430. The drilling fluid may transport cuttings from the borehole 404 into the retention pit 430 and may aid in maintaining the integrity of the borehole 404. The drilling fluid may also drive the downhole motor 420.

The drill string 402 may include an electronics enclosure with a glass portion 432. In some examples, the electronics enclosure with the glass portion 432 may house a ranging tool 434. The ranging tool 434 may induce a current in nearby conductors such as pipes, casing strings, electronics, and conductive formations to collect measurements of the resulting field to determine distance and direction.

Using these measurements in combination with tool orientation measurements can provide data for steering the drill bit 408 along the directional borehole 404 using any one of various suitable directional drilling systems, including steering vanes, a "bent sub," or the rotary steerable system 406. In some examples, the steering mechanism can be controlled downhole with a downhole controller programmed to follow a drill plan, adjust a drill plan, or create new drill plans. The ranging tool 434 may be a deep-reading azimuthal resistivity sensor.

Figure 5:
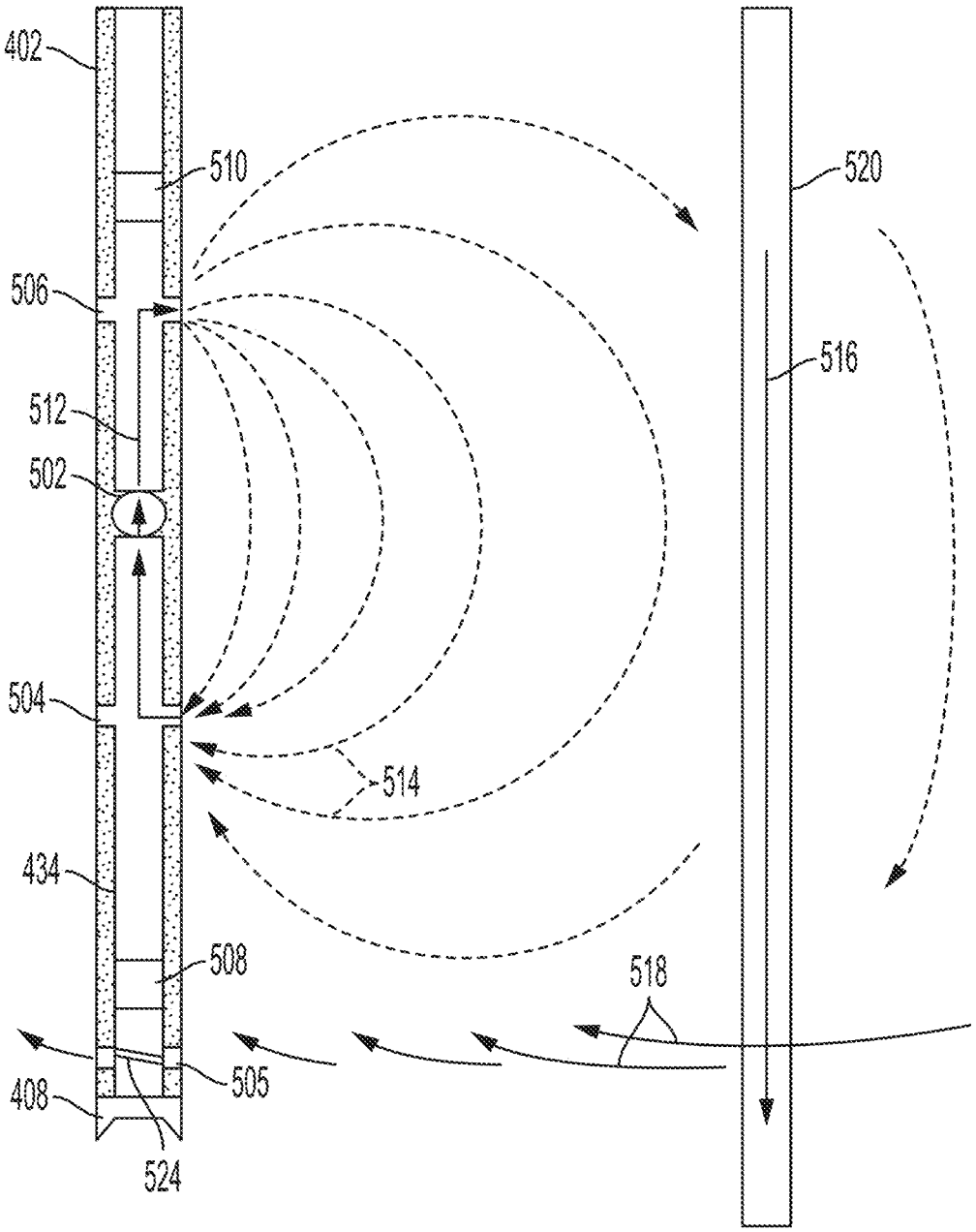
FIG. 5 is a schematic of a ranging tool according to one example of the present disclosure.

FIG. 5 is a schematic of a ranging tool 434 according to one example of the present disclosure. The ranging tool 434 includes two bridges 504, 506 that establish a low impedance path between the current source 502 and the surrounding formation. The ranging tool 434 may further include electrical insulators 508, 510 to confine the current flow from the current source 502. The current source 502 injects a current 512 that disperses outwardly in the surrounding formation as formation currents 514. Where such formation currents 514 encounter a conductive object such as a low resistivity formation or a well casing 520, they preferentially follow the low resistance path as a secondary current 516.

The secondary current 516 generates a detectable, perpendicular magnetic field 518. At least one receiver antenna 524 is oriented at an angle that may increase sensitivity to transverse fields as the drill string 402 rotates.

Portions of the two bridges 504, 506 may include a glass portion that may allow the formation currents 514 to propagate from the current source 502 and be received by the ranging tool 434. In some examples, a portion of the ranging tool 434 may include a glass portion 505 adjacent to the receiver antenna 524 to allow reception of the magnetic field 518 resulting from low resistivity formations or well casing 520.

The glass portions of the two bridges 504, 506 or the glass portion 505 adjacent to the receiver antenna 524 may protect the ranging tool 434 from a wellbore environment and act as a chemical shield. This may include protection from corrosive chemicals, moisture, oxidization, high absolute pressure, large changes in pressure, high temperatures, large changes in temperature, vibrations, and abrasion.

The glass portions of the two bridges 504, 506 or the glass portion 505 adjacent to the receiver antenna 524 may be constructed from chemically strengthened glass. A chemical strengthening process may involve immersing glass in a high temperature, potassium-salt, ion-exchange bath. The glass may be an alkali-aluminosilicate glass.

A contact area between the metal or metallic alloy body of the ranging tool 434 and the glass portions of the two bridges 504, 506 may contain a resin-based epoxy. A contact area between the metal or metallic body of the ranging tool 434 and the glass portion 505 adjacent to the receiver antenna 524 may also contain a resin-based epoxy. The length of such a contact area may be constructed to slow the diffusion of air, water, caustic chemicals, or other contaminants from the wellbore environment to the interior of the ranging tool 434.

Vacuum casting, or similar techniques, may be used to fill the ranging tool 434 with a heat resistant polymer. The heat resistant polymer may reinforce the glass portions of the two bridges 504, 506 or the glass portion 505 adjacent to the receiver antenna 524. The ranging tool 434 may also be filled with a pressure compensated fluid. In some examples, the glass portions of the two bridges 504, 506 or the glass portion 505 adjacent to the receiver antenna 524 may be partially or fully covered with a rubber or plastic lining.

Figure 6:
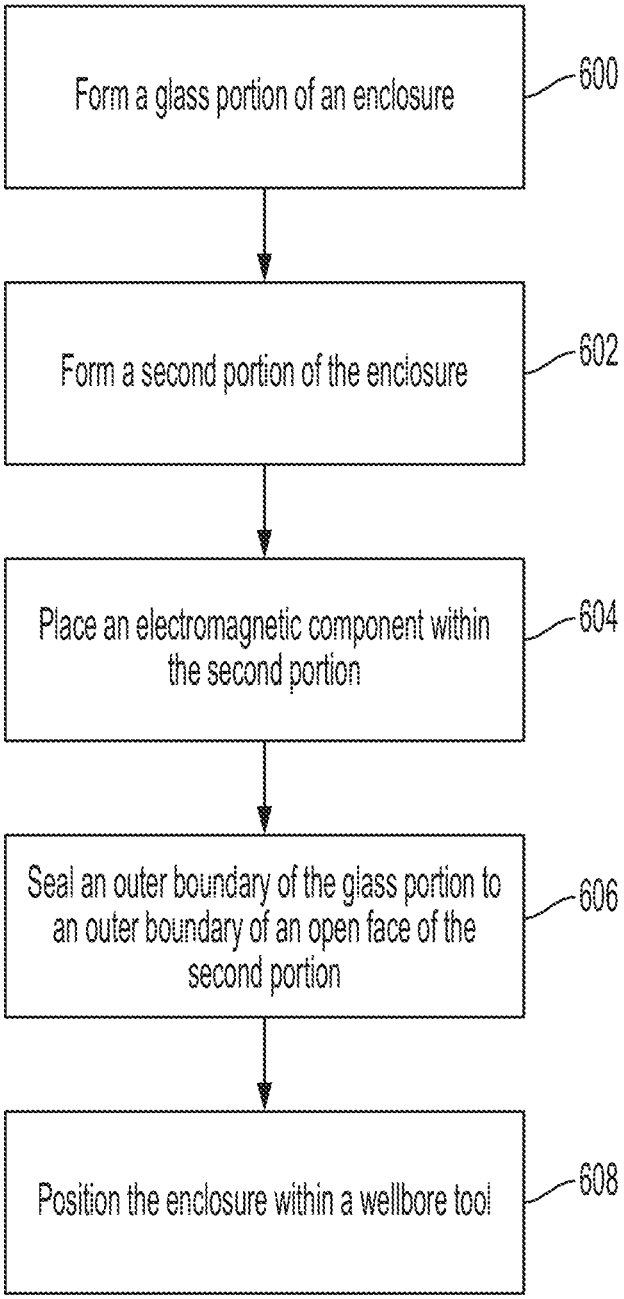
FIG. 6 is a flow chart of a process for constructing an electronics enclosure with a glass portion according to one example of the present disclosure.

FIG. 6 is a flow chart of a process for constructing an electronics enclosure with a glass portion according to one example of the present disclosure. In block 600, a glass portion of an enclosure is formed. The glass portion may be constructed from heat tempered glass. The glass portion may be constructed from laminated glass. The glass portion may include multiple panes of layered glass. The glass portion may be constructed from chemically strengthened glass. A chemical strengthening process may involve immersing glass in a high temperature, potassium-salt, ion-exchange bath. The glass may be an alkali-aluminosilicate glass, borosilicate glass, soda-lime glass, or any other suitable composition of glass. Brands of chemically strengthened glass that may be suitable for the glass portion include Gorilla Glass®, Lotus Glass®, or Willow Glass®. The glass may be lined with a rubber or plastic coating.

In block 602, a second portion of the enclosure is formed. The second portion may have a volume sufficient to hold an electromagnetic component. The second portion of the enclosure may be constructed from metal, a metallic alloy, or glass. The glass portion, the second portion, or both may be structurally integral to drilling, completion, or production equipment. The second portion may be lined with a rubber or plastic coating.

In block 604, an electromagnetic component is placed within the second portion. Electromagnetic components may include sensors, antennas, transmitters, solenoids, transformers, inductive couplers, circuitry, processing devices, amplifiers, motors, batteries, electromagnets, or capacitors. The electromagnetic component may be a deep-reading azimuthal resistivity sensor.

In block 606, an outer boundary of the glass portion may be sealed to an outer bounder of an open face of the second portion. The glass portion may be heated locally to conform to a shape compatible with the second portion. In some examples, the glass portion may be melted without affecting the electromagnetic component.

The glass portion and the second portion may be sealed together with a resin-based epoxy. The contact area at which the outer boundary of the glass portion meets the outer boundary of the second portion may possess a length that is at least twice the thickness of the glass portion. The portion of the contact area exposed to the wellbore environment may be lined with a rubber or plastic coating.

In block 608, the electronics enclosure may be positioned within a wellbore tool. The wellbore tool may be for a drilling, production, or completion operation. The glass portion of the sealed enclosure may be positioned adjacent to a glass portion of a second electronics enclosure for allowing the electromagnetic component housed within the enclosure to electromagnetically couple to another electromagnetic component housed within the second electronics enclosure. One such example is depicted within FIG. 2 and FIG. 3.

In some examples, the electronics enclosure may be positioned within a first part of a downhole assembly. A second electronics enclosure may be positioned within a second part of the downhole assembly, adjacent to the first part of the downhole assembly. The first part of the downhole assembly may be coupled to the second part of the downhole assembly such that the glass portion of the sealed enclosure is adjacent to the glass portion of the second electronics enclosure to allow electromagnetic communication between the electromagnetic components housed within each enclosure.

In some aspects, apparatus, methods, and systems for an electronics enclosure are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a sealed enclosure positionable in a wellbore, the sealed enclosure comprising: a glass portion positioned with respect to an area defined by the sealed enclosure to prevent fluid from an environment of the wellbore from contacting an electromagnetic component that is positionable in the area and to allow the electromagnetic component to wirelessly communicate with a component external to the sealed enclosure; and a second portion that interfaces with the glass portion for preventing the fluid from the environment of the wellbore from contacting the electromagnetic component.

Example 2 is the sealed enclosure of example(s) 1, further comprising a resin between the glass portion and a metal surface of the second portion, wherein a contact area that includes the resin has a length that is at least twice a thickness of the glass portion.

Example 3 is the sealed enclosure of example(s) 1, wherein the glass portion is positionable adjacent to a second glass portion of a second sealed enclosure for allowing the electromagnetic component to couple to a second electromagnetic component positioned in the second sealed enclosure.

Example 4 is the sealed enclosure of example(s) 3, wherein: the sealed enclosure is integral to a first part of a downhole assembly; the second sealed enclosure is integral to a second part of the downhole assembly; and the first part of the downhole assembly and the second part of the downhole assembly are couplable such that the glass portion of the sealed enclosure is positionable adjacent to the second glass portion of the second sealed enclosure to allow electromagnetic communication between the electromagnetic component and the second electromagnetic component.

Example 5 is the sealed enclosure of example(s) 1, wherein the sealed enclosure is directed within a deep-reading azimuthal resistivity sensor to provide a magnetic field to an axially spaced antenna of the deep-reading azimuthal resistivity sensor.

Example 6 is the sealed enclosure of example(s) 1, wherein: the second portion is glass; and the glass portion and the second portion are integrally formed together.

Example 7 is the sealed enclosure of example(s) 1, wherein the sealed enclosure is a chemical shield for preventing the fluid from the environment of the wellbore from contacting the electromagnetic component.

Example 8 is a wellbore tool comprising: a sealed enclosure comprising: a glass portion positionable with respect to an electromagnetic component that is in an area defined by the sealed enclosure to prevent fluid from an environment of a wellbore from contacting the electromagnetic component and to allow the electromagnetic component to wirelessly communicate with a component external to the sealed enclosure; and a second portion to interface with the glass portion for preventing the fluid from the environment of the wellbore from contacting the electromagnetic component; the electromagnetic component; and a first part of a downhole assembly, for housing the sealed enclosure such that the electromagnetic component is positioned to wirelessly communicate with a second electromagnetic component housed in a second part of the downhole assembly configured to accept the first part of the downhole assembly.

Example 9 is the wellbore tool of example(s) 8, further comprising a resin between the glass portion and a metal surface of the second portion, wherein a contact area that includes the resin has a length that is at least twice a thickness of the glass portion.

Example 10 is the wellbore tool of example(s) 8, wherein the glass portion is positionable adjacent to a second glass portion of a second sealed enclosure for allowing the electromagnetic component to couple to the second electromagnetic component positioned in the second sealed enclosure.

Example 11 is the wellbore tool of example(s) 8, wherein: the second portion is glass; and the glass portion and the second portion are integrally formed together.

Example 12 is the wellbore tool of example(s) 8, wherein the sealed enclosure is a chemical shield for preventing the fluid from the environment of the wellbore from contacting the electromagnetic component.

Example 13 is the wellbore tool of example(s) 8, wherein a surface of the glass portion opposite the area defined by the sealed enclosure is at least partially covered by a rubber coating.

Example 14 is a method comprising: forming a glass portion of an enclosure with a length of the glass portion exceeding an open face of a second portion of the enclosure by at least twice a thickness of the glass portion and a width of the glass portion exceeding the open face of the second portion of the enclosure by at least twice the thickness of the glass portion; forming the second portion of the enclosure with a volume sufficient to hold an electromagnetic component; placing the electromagnetic component within the second portion of the enclosure; sealing a first outer boundary of the glass portion to a second outer boundary of the open face of the second portion such that the glass portion and the second portion define a sealed enclosure for chemically shielding the electromagnetic component; and positioning the enclosure within a wellbore tool.

Example 15 is the method of example(s) 14, further comprising: sealing the first outer boundary of the glass portion to the second outer boundary of the open face of the second portion with a resin that covers an area at least twice the thickness of the glass portion.

Example 16 is the method of example(s) 14, further comprising: positioning the glass portion of the sealed enclosure to be adjacent to a second glass portion of a second sealed enclosure for allowing the electromagnetic component to couple to a second electromagnetic component.

Example 17 is the method of example(s) 16, further comprising: enclosing the sealed enclosure in a first part of a downhole assembly; enclosing the second sealed enclosure in a second part of the downhole assembly; and coupling the first part of the downhole assembly to the second part of the downhole assembly such that the glass portion of the sealed enclosure is positionable adjacent to the second glass portion of the second sealed enclosure to allow electromagnetic communication between the electromagnetic component and the second electromagnetic component.

Example 18 is the method of example(s) 14, further comprising: directing the sealed enclosure within a deep-reading azimuthal resistivity sensor, integrated within a conductive tubular, to provide a magnetic field to an axially spaced antenna of the deep-reading azimuthal resistivity sensor that is also integrated within the conductive tubular.

Example 19 is the method of example(s) 14, wherein: the second portion is glass; and the glass portion and the second portion are integrally formed together.

Example 20 is the method of example(s) 14, wherein a surface of the glass portion opposite an area defined by the sealed enclosure is at least partially covered by a rubber coating.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A sealed enclosure positionable in a wellbore, the sealed enclosure comprising:

a glass portion positioned with respect to an area defined by the sealed enclosure to prevent fluid from an environment of the wellbore from contacting an electromagnetic component that is positionable in the area and to allow the electromagnetic component to wirelessly communicate with a component external to the sealed enclosure;

a second portion that interfaces with the glass portion for preventing the fluid from the environment of the wellbore from contacting the electromagnetic component; and a resin between the glass portion and a metal surface of the second portion, wherein a contact area between the glass portion and the second portion that includes the resin has a length that is at least twice a thickness of the glass portion.

2. The sealed enclosure of claim 1, wherein the electromagnetic component is couplable to a second electromagnetic component positioned in a second sealed enclosure when the glass portion of the sealed enclosure resides adjacent to a second glass portion of the second sealed enclosure.

3. The sealed enclosure of claim 2, wherein:

the sealed enclosure is integral to a first part of a downhole assembly;

the second sealed enclosure is integral to a second part of the downhole assembly; and the first part of the downhole assembly and the second part of the downhole assembly are couplable such that the glass portion of the sealed enclosure is positionable adjacent to the second glass portion of the second sealed enclosure to allow electromagnetic communication between the electromagnetic component and the second electromagnetic component.

4. The sealed enclosure of claim 1, wherein the sealed enclosure is directed within a deep-reading azimuthal resistivity sensor to provide a magnetic field to an axially spaced antenna of the deep-reading azimuthal resistivity sensor.

5. The sealed enclosure of claim 1, wherein:

the second portion is glass; and the glass portion and the second portion are integrally formed together.

6. The sealed enclosure of claim 1, wherein the sealed enclosure is a chemical shield for preventing the fluid from the environment of the wellbore from contacting the electromagnetic component.

7. A wellbore tool comprising:

a sealed enclosure comprising:

a glass portion positionable with respect to an electromagnetic component that is in an area defined by the sealed enclosure to prevent fluid from an environment of a wellbore from contacting the electromagnetic component and to allow the electromagnetic component to wirelessly communicate with a component external to the sealed enclosure;

a second portion to interface with the glass portion for preventing the fluid from the environment of the wellbore from contacting the electromagnetic component; and a resin between the glass portion and a metal surface of the second portion, wherein a contact area between the glass portion and the second portion that includes the resin has a length that is at least twice a thickness of the glass portion;

the electromagnetic component; and a first part of a downhole assembly, for housing the sealed enclosure such that the electromagnetic component is positioned to wirelessly communicate with a second electromagnetic component housed in a second part of the downhole assembly configured to accept the first part of the downhole assembly.

8. The wellbore tool of claim 7, wherein the glass portion is positionable adjacent to a second glass portion of a second sealed enclosure for allowing the electromagnetic component to couple to the second electromagnetic component positioned in the second sealed enclosure.

9. The wellbore tool of claim 7, wherein:

the second portion is glass; and the glass portion and the second portion are integrally formed together.

10. The wellbore tool of claim 7, wherein the sealed enclosure is a chemical shield for preventing the fluid from the environment of the wellbore from contacting the electromagnetic component.

11. The wellbore tool of claim 7, wherein a surface of the glass portion opposite the area defined by the sealed enclosure is at least partially covered by a rubber coating.

12. A method comprising:

forming a glass portion of an enclosure with a length of the glass portion exceeding an open face of a second portion of the enclosure by at least twice a thickness of the glass portion and a width of the glass portion exceeding the open face of the second portion of the enclosure by at least twice the thickness of the glass portion;

forming the second portion of the enclosure with a volume sufficient to hold an electromagnetic component;

placing the electromagnetic component within the second portion of the enclosure;

sealing a first outer boundary of the glass portion to a second outer boundary of the open face of the second portion with a resin that covers an area at least twice the thickness of the glass portion such that the glass portion and the second portion define a sealed enclosure for chemically shielding the electromagnetic component; and positioning the enclosure within a wellbore tool.

13. The method of claim 12, further comprising:

positioning the glass portion of the sealed enclosure to be adjacent to a second glass portion of a second sealed enclosure for allowing the electromagnetic component to couple to a second electromagnetic component.

14. The method of claim 13, further comprising:

enclosing the sealed enclosure in a first part of a downhole assembly;

enclosing the second sealed enclosure in a second part of the downhole assembly; and coupling the first part of the downhole assembly to the second part of the downhole assembly such that the glass portion of the sealed enclosure is positionable adjacent to the second glass portion of the second sealed enclosure to allow electromagnetic communication between the electromagnetic component and the second electromagnetic component.

15. The method of claim 12, further comprising:

directing the sealed enclosure within a deep-reading azimuthal resistivity sensor, integrated within a conductive tubular, to provide a magnetic field to an axially spaced antenna of the deep-reading azimuthal resistivity sensor that is also integrated within the conductive tubular.

16. The method of claim 12, wherein:

the second portion is glass; and the glass portion and the second portion are integrally formed together.

17. The method of claim 12, wherein a surface of the glass portion opposite an area defined by the sealed enclosure is at least partially covered by a rubber coating.

* * * * *